US009067750B2

(12) United States Patent
Casey et al.

(10) Patent No.: US 9,067,750 B2
(45) Date of Patent: Jun. 30, 2015

(54) METHOD AND APPARATUS FOR SPLICING A PAPER ROLL

(75) Inventors: David W. Casey, Salisbury, NC (US); Gregg A. Bryan, Mooresville, NC (US); Karl U. Wuerminghausen, Canton, OH (US)

(73) Assignee: Greif Packaging LLC, Delaware, OH (US)

( * ) Notice: Subject to any disclaimer, the term of this patent is extended or adjusted under 35 U.S.C. 154(b) by 316 days.

(21) Appl. No.: 13/032,684

(22) Filed: Feb. 23, 2011

(65) Prior Publication Data

US 2012/0211142 A1 Aug. 23, 2012

(51) Int. Cl.
*B65H 19/18* (2006.01)
*B26D 1/30* (2006.01)

(52) U.S. Cl.
CPC ..... *B65H 19/1852* (2013.01); *B26D 1/305* (2013.01); *B65H 2301/4607* (2013.01); *B65H 2301/46174* (2013.01); *B65H 2301/4621* (2013.01); *B65H 2301/46414* (2013.01); *B65H 2301/50* (2013.01); *B65H 2551/20* (2013.01); *B65H 2557/51* (2013.01); *B65H 2601/31* (2013.01); *B65H 2601/325* (2013.01); *B65H 2701/1762* (2013.01)

(58) Field of Classification Search
CPC ..... B65H 19/1852; B65H 2701/1762; B65H 2601/325; B65H 2601/31; B65H 2301/31; B65H 2551/20; B65H 2301/46174; B65H 2301/50; B65H 2557/51; B65H 2301/4621; B65H 2301/46414; B26D 1/305
USPC ..... 156/64, 351, 361, 378, 510, 538; 242/554.1, 554.6, 555, 555.6
See application file for complete search history.

(56) References Cited

U.S. PATENT DOCUMENTS

| | | | | |
|---|---|---|---|---|
| 3,973,493 | A * | 8/1976 | Black et al. | 101/126 |
| 5,437,749 | A * | 8/1995 | Pipkorn et al. | 156/64 |
| 5,783,007 | A * | 7/1998 | Boyd et al. | 156/64 |
| 5,895,535 | A * | 4/1999 | Bentz | 156/64 |
| 6,192,955 | B1 * | 2/2001 | Rice | 156/351 |
| 2003/0146338 | A1 * | 8/2003 | Hogberg et al. | 242/596.1 |

* cited by examiner

*Primary Examiner* — George Koch
(74) *Attorney, Agent, or Firm* — Sand & Sebolt

(57) ABSTRACT

A splicing machine having an alignment mechanism is provided for aligning an end edge of a web of paperboard in preparation for splicing two webs of paperboard. An image display device such as a mirror or display screen allow an operator to view images of the end edge of the web and the alignment position to facilitate aligning the end edge at the alignment position. The alignment position is typically marked by an alignment marker produced by light, such as a laser beam.

19 Claims, 15 Drawing Sheets

METHOD AND APPARATUS FOR SPLICING A PAPER ROLL

BACKGROUND OF THE INVENTION

1. Technical Field

The present invention relates generally to a method and apparatus for splicing a roll of paperboard with another roll of paperboard. More particularly, the present invention relates to a method and apparatus for aligning the leading end edge of a roll of paperboard prior to the splicing of the two rolls. Specifically, the invention relates to the use of an image-display device which allows the operator of the machine to see an image of the leading edge and an alignment marker which may be formed by a laser or other form of light.

2. Background Information

Splicing machines or splicers are well known in the art for splicing the web from one roll of paperboard with the web of another roll of paperboard. Modern splicers allow the leading edge of the new roll to be spliced to the trailing edge of the old roll while the web from the old roll continues to move downstream within the splicer and to subsequent paperboard handling machines such as corrugators or the like. Before the new roll is spliced to the old roll, the operator will typically align the leading end edge of the new roll along the splice head of the machine so that the leading end edge is at the proper position relative to the splice head in order to properly splice the webs to one another. Due to the relatively large diameter of the paperboard rolls, the typical splicing machine is configured so that the splice head and associated components are spaced upwardly from the floor to which the machine is secured. As a result, the operator cannot see the alignment position at which the leading end edge of the new roll should be aligned prior to the splicing. Thus, the operator must perform the alignment process by feel, reaching upwardly and over a protective plate and splice roll in an attempt to properly align the paperboard web. Current machines typically have a pivotable arm which serves as an alignment marker which the operator can feel with his or her hands in order to align the paperboard web therewith by feel. Although the operator could stand on an elevated surface such as a stepstool or ladder in order to see the alignment position and leading edge of the new roll, the climbing involved would create an additional potential hazard. In addition, the use of stepstools, ladders or the like would create clutter around the splicing machine which would be a hindrance to movement of the operator or others around the machine and could also potentially be a tripping hazard. The present invention addresses these problems in the art.

BRIEF SUMMARY OF THE INVENTION

The present invention provides a method comprising the steps of: providing an image display device; viewing with the image display device an image of an end edge of a first web of a first paperboard roll; and aligning the end edge adjacent a splice head of a paperboard splicing machine during the step of viewing.

The present invention also provides an apparatus comprising: a paperboard splicing machine having an edge alignment position; a paperboard roll support of the machine adapted to support a roll of paperboard comprising a first web having an end edge alignable with the edge alignment position; an operator alignment and viewing position which is adjacent the splicing machine and at which an operator is positioned during alignment of the end edge of the first web with the edge alignment position; and an image display on which an image of the edge alignment position is viewable from the alignment and viewing position.

The present invention further provides an apparatus comprising: a paperboard splicing machine; a splice head of the machine; an edge alignment position which is adjacent the splice head and with which an end edge of a first web of paperboard is alignable; a light-emitting device having an activated mode in which the device emits light which produces an alignment marker at the edge alignment position; and a mirror in which a reflected image of the alignment marker is viewable from a position adjacent the machine.

BRIEF DESCRIPTION OF THE SEVERAL VIEWS OF THE DRAWINGS

A preferred embodiment of the invention, illustrated of the best mode in which Applicant contemplates applying the principles, is set forth in the following description and is shown in the drawings and is particularly and distinctly pointed out and set forth in the appended claims.

Similar numbers refer to similar parts throughout the drawings.

DETAILED DESCRIPTION OF THE INVENTION

Figure 1:
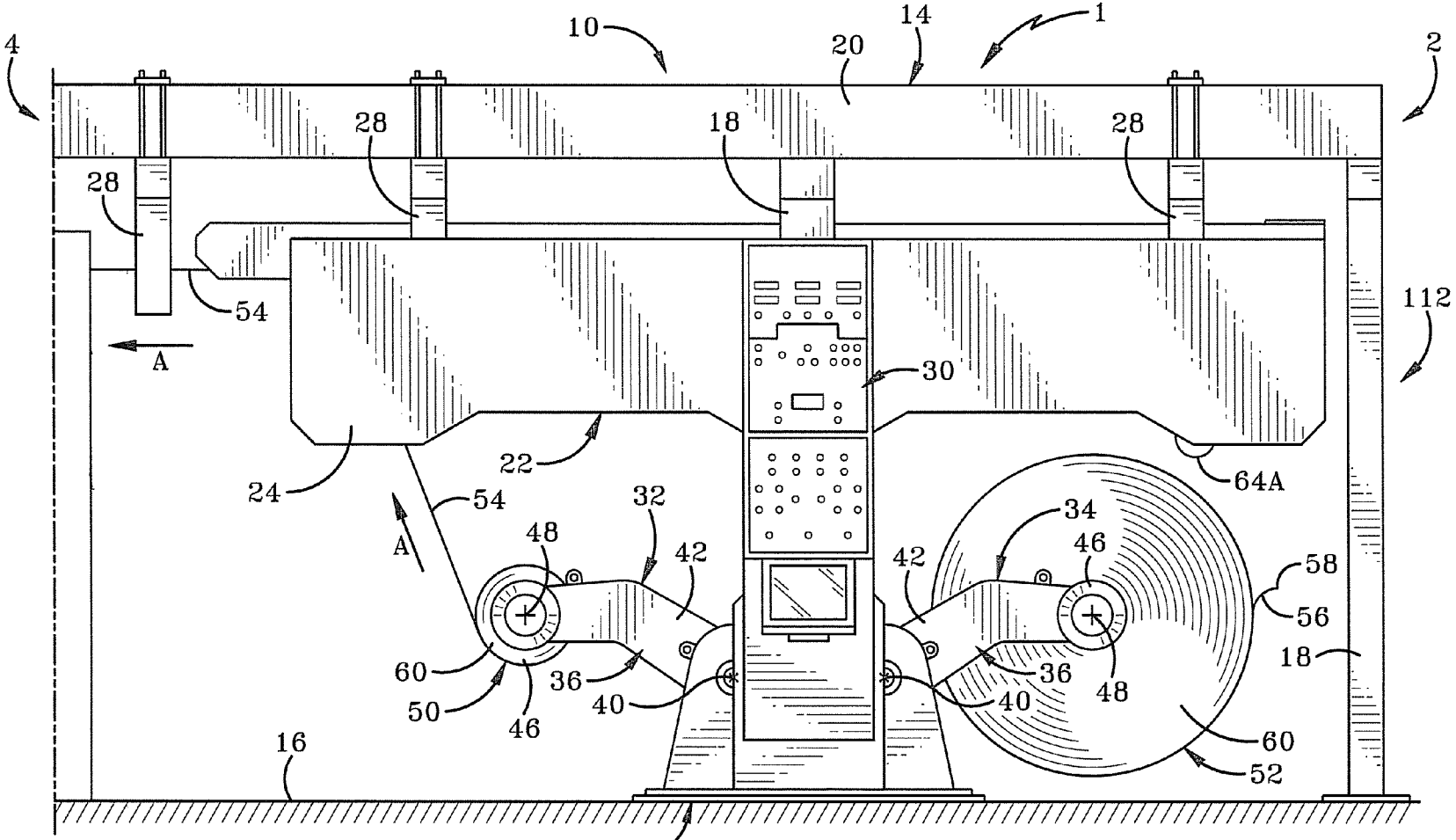
FIG. 1 is a side elevational view of the splicing machine or splicer of the present invention.

The splicing machine or splicer of the present invention is indicated generally at 1 in FIG. 1. Splicer 1 has an upstream end 2 and a downstream end 4 defining therebetween a longitudinal direction of the machine. Splicer 1 has a left side 6 and a right side 8 (FIG. 3) defining therebetween an axial direction of the machine. Splicer 1 has a top 10 and a bottom 12 defined by a rigid frame 14 thereof such that the bottom 12 of frame 14 is seated on and rigidly secured to a horizontal flat floor 16. Frame 14 includes a plurality of uprights 18 which support left and right upper rails 20 and various crossbars. Frame 14 further includes a carriage and roll mounting assembly 22 including left and right mounting members or rails 24 and 26 which are rigidly secured to the upper crossbars and rails 20 via hangers 28.

A control 30 is mounted on frame 14 and includes a computer and computer program and appropriate electrical circuitry for controlling the various operations of machine 1. First and second roll support assemblies 32 and 34 are pivotally mounted on frame 14 about pivots 40 to pivot about parallel horizontal axially extending axes. Each of assemblies 32 and 34 includes a left arm assembly 36 and a right arm assembly 38 pivotally mounted about axis 40 and including a pivot arm 42, a chuck 44 and a brake 46. The opposed chucks 44 of each assembly 32 or 34 cooperate to mount thereon a given paperboard roll such that each chuck 44 and the paperboard roll is rotatable about a respective axis 48 parallel to axis 40. More particularly, one paperboard roll 50 is rotatably mounted on the chucks of first assembly 32, and another paperboard roll 52 is rotatably mounted on the chucks of second assembly 34 upstream of assembly 32 and roll 50. For the purposes of the present discussion, roll 50 is considered to be an old roll while roll 52 is considered to be a new roll inasmuch as old roll 52 has been substantially depleted by the unwinding thereof and the new roll 52 will ultimately be spliced to the old roll. Old roll 50 has a web 54 of paperboard and new roll 52 has a web 56 of paperboard which has an original leading end edge 58 which is referred to herein as original inasmuch as a portion of the paperboard will be subsequently cut off to produce a new leading end edge as described further below. Each roll 50 and 52 has left and right sides or ends 60 and 62 which also serve as the left side edges of the respective web 54 and 56.

Figure 2:
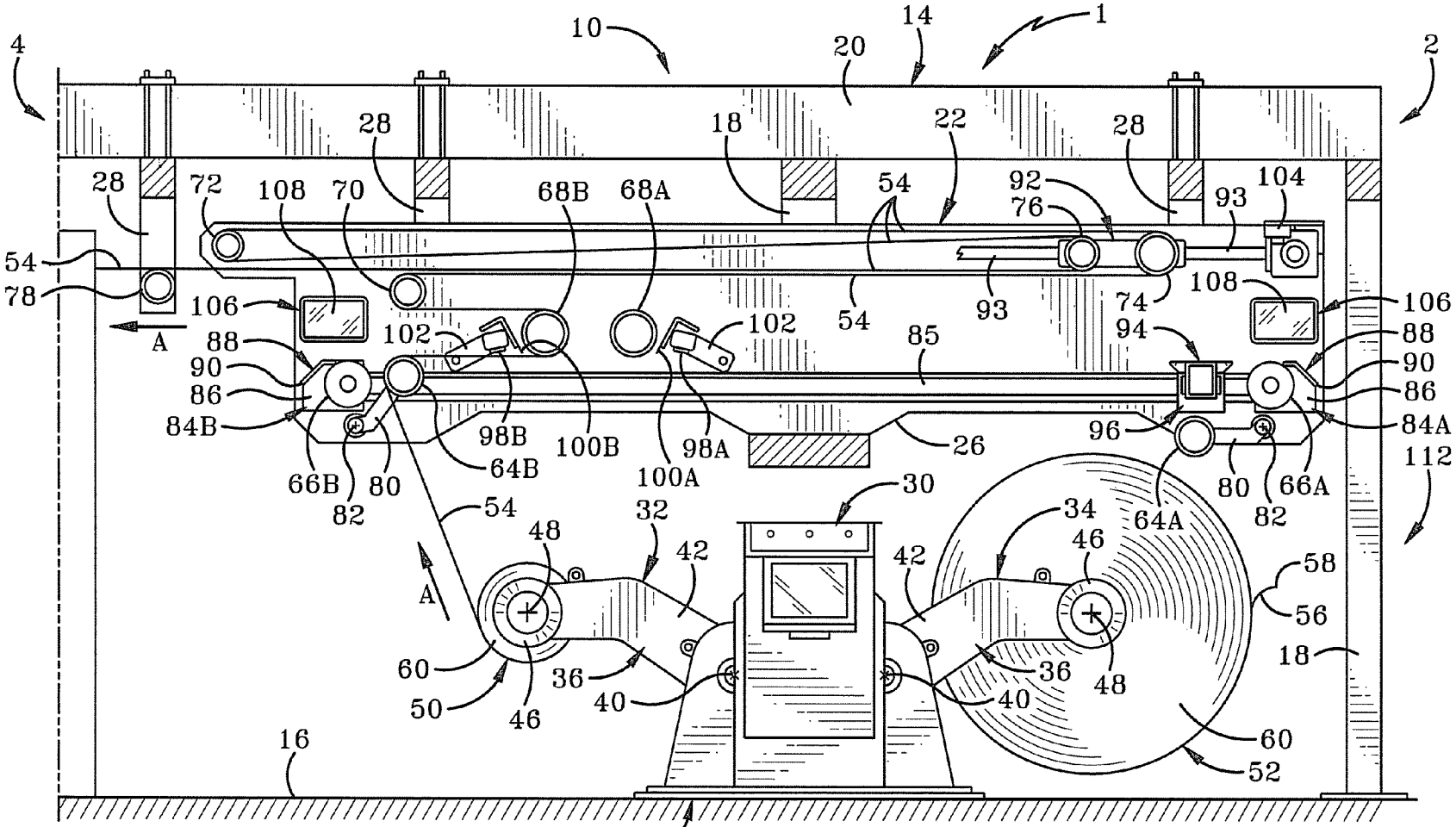
FIG. 2 is a sectional view taken from the side of the splicer.

Referring primarily to FIG. 2, the webs of paperboard are ultimately threaded through and wound around a plurality of rolls which are rotatably mounted to rotate about respective parallel horizontal axially extending axes. Not all of these rolls are necessarily in operation simultaneously inasmuch as some of the rolls are primarily associated with web 54 of the old roll 50 whereas other of the rolls are primarily associated with web 56 of the new roll 52. Amongst these rolls are pivotable guide rolls 64A and 64B, splice rolls 66A and 66B, pressure rolls 68A and 68B, fixed festoon rolls 70 and 72, movable festoon rolls 74 and 76, and exit guide roll 78. Each of these rolls is axially elongated and extends between left mounting member 24 and right mounting member 26 with the respective left and right ends of each roll adjacent left and right members 24 and 26. Guide rolls 64 are rotatably mounted on pivot arms 80, which are rotatably mounted on mounting members 24 and 26 via respective pivots 82 whereby each roll 64 is pivotally movable about the horizontal axially extending axis of pivot 82. Splice rolls 66A and 66B are respectively rotatably mounted on splice carriages 84A and 84B. Each splice carriage is longitudinally horizontally movable with its respective splice roll 66 along respective tracks 85 (only one shown in FIG. 2) along mounting members 24 and 26. Each splice carriage is typically moved along the track by respective pinions which engage a horizontal rack extending along the full length of track 85, although other methods may be used. Each carriage 84 includes left and right end plates 86 (only one shown in FIG. 2) and axially elongated protective plate 88 extending between and rigidly connected to the end plates 86. Plate 88 includes a first or upper substantially flat horizontal plate segment 87 and a second or lower flat plate segment which angles downwardly and away from its intersection with plate segment 87 (FIG. 4) such that the intersection defines an angle 91 extending from the left end plate to the right end plate. The lower end of plate segment 89 defines a horizontal axial cutting edge 90 extending across the machine from the left end plate to the right end plate.

With continued reference to FIG. 2, splicer 1 further includes a festoon carriage 92 on which movable rolls 74 and 76 are rotatably mounted. Festoon carriage 92 is movable back and forth in the longitudinal direction along a festoon carriage track 93 (only one shown in FIG. 2) along each of members 24 and 26. Festoon carriage 92 thus is able to move back and forth along the track in a similar manner as splice carriage 84, typically using the pinion and rack configuration or any other suitable mechanism. An axial clamping bar 94 is also mounted on the frame via a clamping bar carriage 96, which also is capable of moving longitudinally in a horizontal direction via track 93, wherein carriage 96 typically has pinions rotatably mounted thereon in order to move along the tracks in the same manner as splice carriage 84. Clamping bar 94, plate 88 and splice roll 66A together form a splice head along which the splicing of webs 54 and 56 will occur as discussed in detail further below. A pair of brake bars 98A and 98B are pivotally mounted on assembly 22 of the frame and extend axially from adjacent left member 24 to adjacent right member 26. Cutting devices typically in the form of axially elongated knives 100A and 100B are respectively mounted adjacent brake bars 98A and 98B and are used for cutting the web of a given roll of paperboard. Each brake bar 98 is pivotally mounted on members 24 and 26 by respective pivot arms 1 and 2.

In accordance with the present invention, a light-emitting device typically in the form of a laser-producing or emitting device 104 is mounted on the frame for the purpose of producing an alignment marker as discussed further below. An image display device 106 is also mounted on the frame and includes an image display 108 in which an operator may see images of the alignment marker and other components as discussed further below. In the exemplary embodiment, display device 106 is a mirror such that image display 108 is the reflective surface thereof. Alternately, device 106 may include a display monitor or screen on which photographic images may be displayed, most typically images which are displayed in real time and taken by a video camera aimed toward the splice head. As discussed in the Background section of the present application, the operator of a standard splicer typically cannot see the alignment position at which the end edge of a given paperboard web is to be aligned. Thus, the image display device 106 allows the operator to see images of the alignment area to facilitate the ability to align the end edge of the paperboard web.

Figure 3:
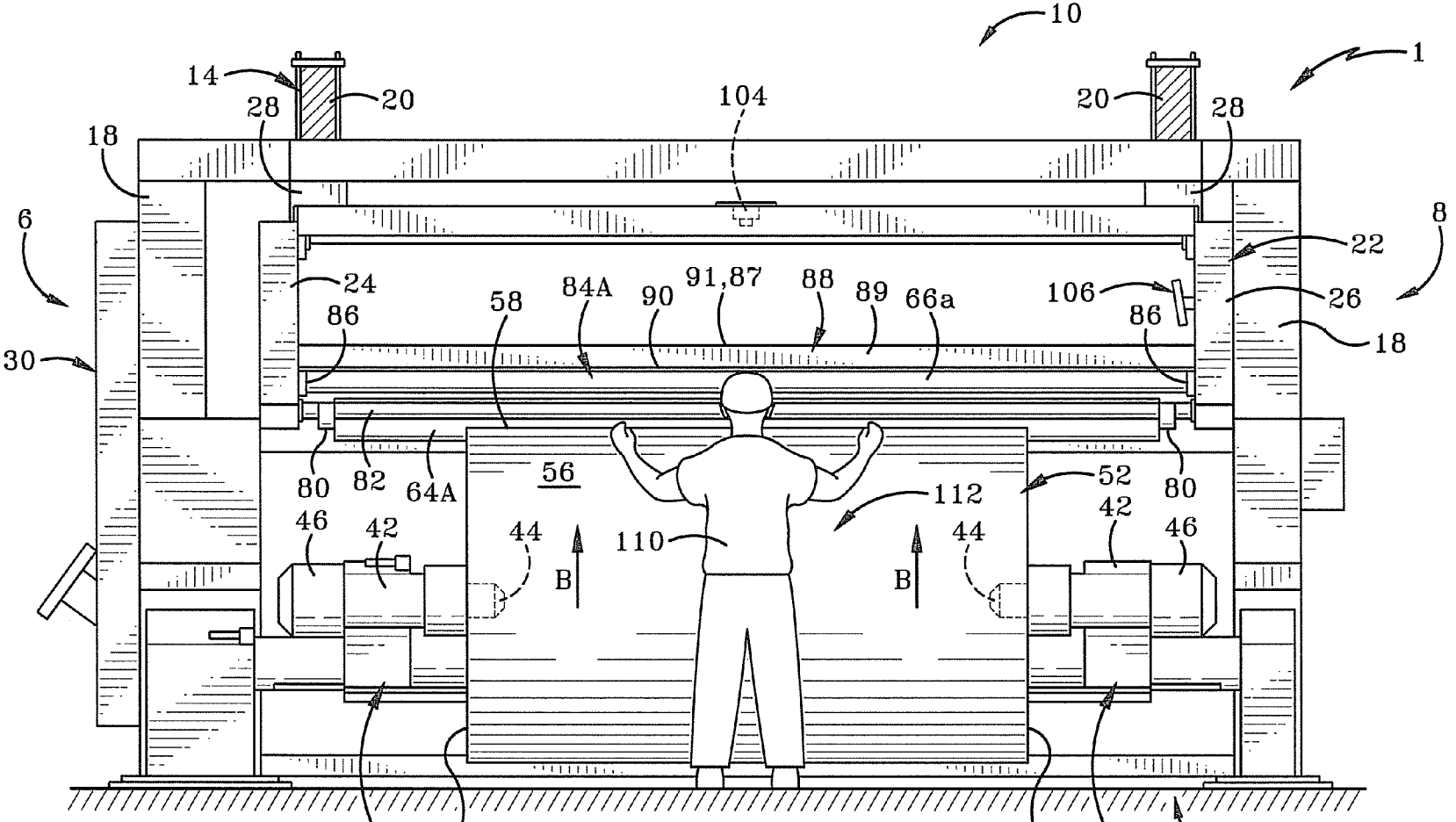
FIG. 3 is a sectional view of the machine looking in the downstream direction and showing the operator adjacent the new paperboard roll at an operator alignment and viewing position.
Figure 4:
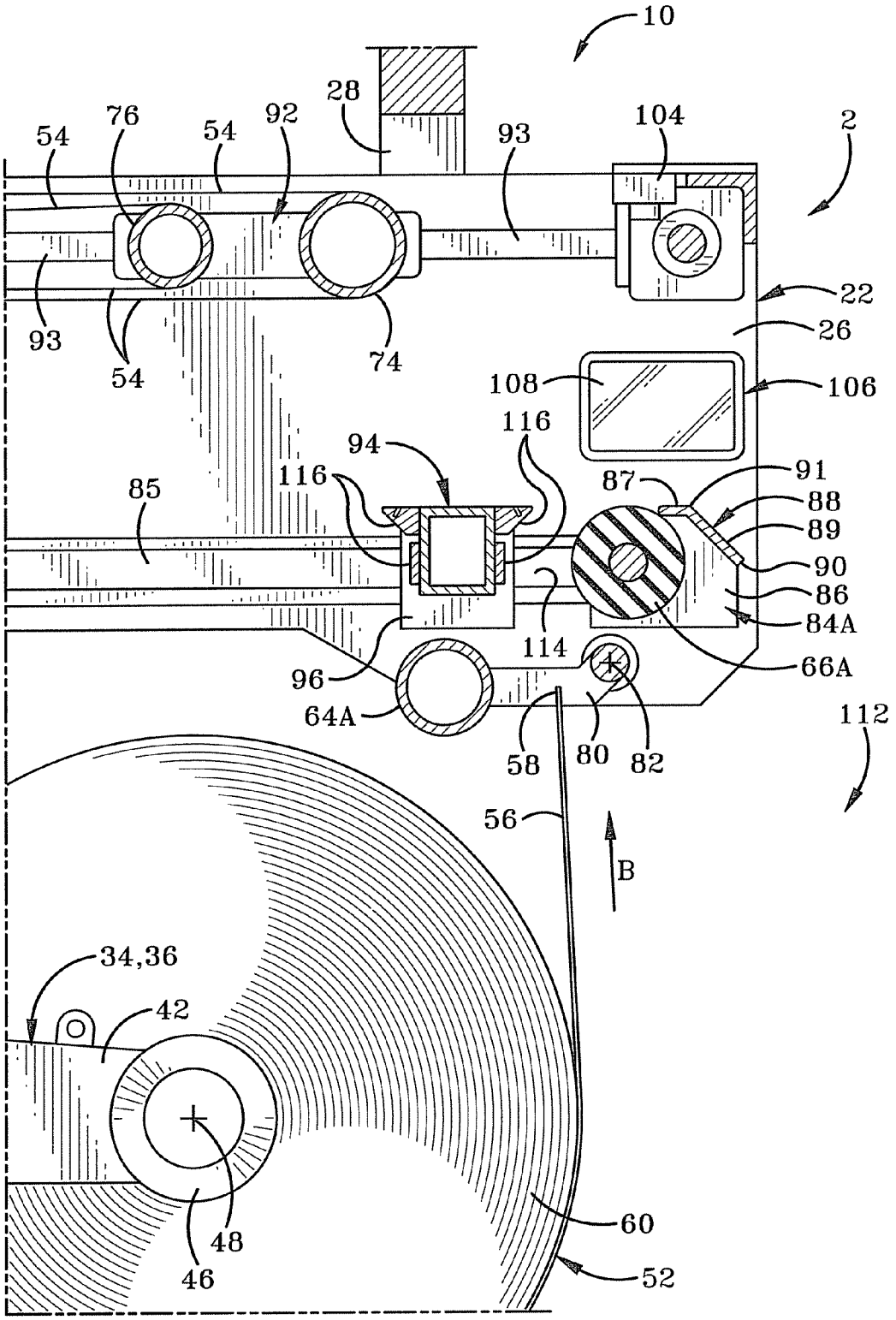
FIG. 4 is an enlarged sectional view of an upstream portion of the splicer showing the new roll at the same stage as shown in FIG. 3, with the leading edge moving upwardly toward the splice roll and clamping bar.
Figure 5:
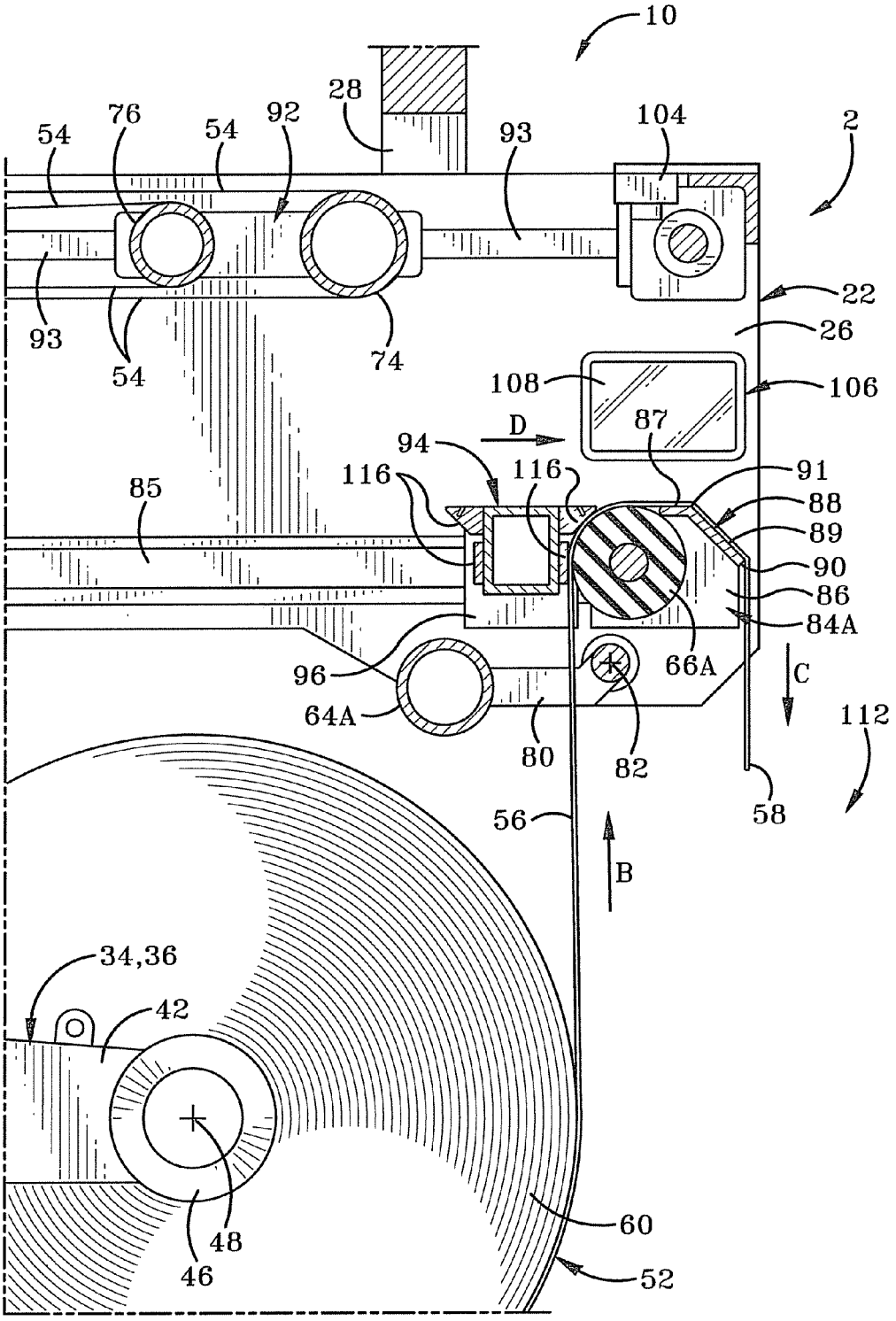
FIG. 5 is similar to FIG. 4 and shows the leading end edge of the new web having been threaded between the clamping bar and splice roll, and over the protective plate.
Figure 6:
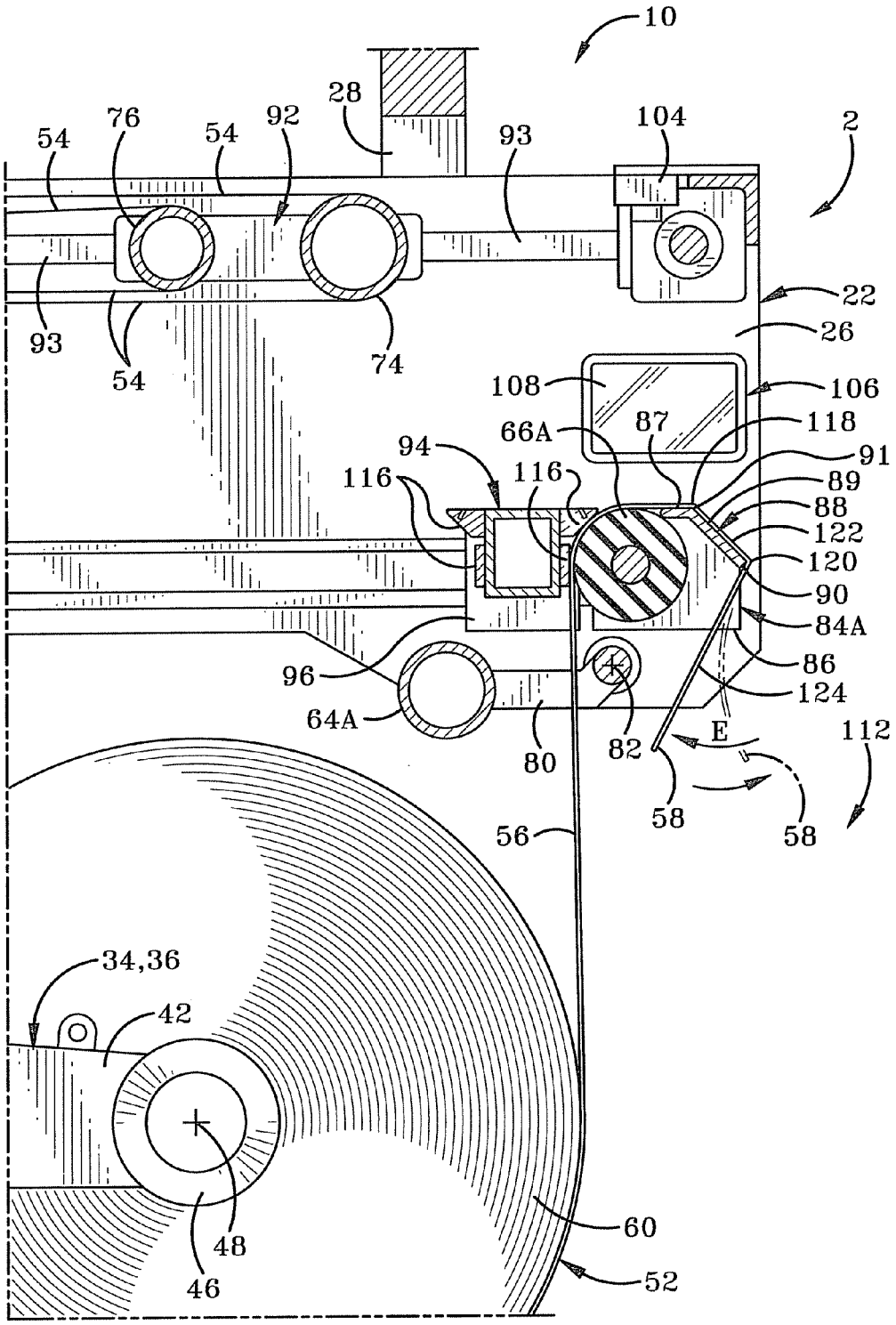
FIG. 6 is similar to FIG. 5 and shows the new web folded around the edges of the protective plate.

The alignment and splicing operation of the present invention will now be described with reference to FIGS. 3-16. The alignment operation begins in FIG. 3 as an operator 110 at an operator alignment and viewing position 112 (at which the operator is typically standing) begins to unwind the web 56 of new roll 52 while the web 54 of the old roll 50 unwinds therefrom and continues to move downstream as indicated at Arrows A in FIGS. 1 and 2. FIG. 2 shows more particularly that web 54 is threaded through the various rolls and more particularly in sequential order around roll 64B, roll 68B, roll 70, roll 74, roll 72, roll 76 and roll 78. Referring again to FIG. 3, the operator alignment and viewing position 112 is adjacent and upstream of new roll 52, typically about midway between left and right ends 60 and 62, generally adjacent the upstream end 2 of the splicer generally adjacent and upstream of the splice head, including the splice carriage 84A, splice roll 66A and clamping bar 94 when they are in their alignment position associated with aligning the end edge 58 of web 56. While operator 110 is in position 112, he or she grabs paperboard web 56 adjacent edge 58 and pulls the web upwards (Arrows B in FIG. 3) to unwind a portion of the web from new roll 52 and move edge 58 upwardly towards the splice head, as shown in FIGS. 3 and 4. Operator 110 continues to manually manipulate web 56 so that edge 58 is inserted upwardly through a space 114 defined between splice roll 66A and clamping pads 116 of clamping bar 94, and then pulled over the top of splice roll 66A and plate 88 so that some excess of web 56 hangs downwardly from cutting edge 90, said movement generally shown by Arrow C in FIG. 5.

Once the web 56 is threaded between the splice roll and clamping bar, clamping bar 94 is moved towards splice roll 66A (Arrow D) in order to lightly clamp web 56 between pads 116 and splice roll 66A. Although not shown in the Figures, a plurality of spring elements spaced along the clamping bar are typically used to apply the relatively light clamping pressure. This relatively light clamping pressure is intended to keep web 56 in place while also allowing the operator to move the web between the splice roll and clamping bar as sufficient force is applied. As discussed further below, a greater clamping force is subsequently applied. After web 56 has been positioned with edge 58 hanging downwardly from cuffing edge 90, operator 110 typically folds web 56 (Arrow E) along angle 91 and cutting edge 90 to form respective folds 118 and 120 (FIG. 6) extending from the left edge 60 to the right edge 62 of the web, thereby creating a flat tape-receiving segment 122 between folds 118 and 120, and a disposable leading segment 124 hanging downwardly from cutting edge 90.

Figure 7:
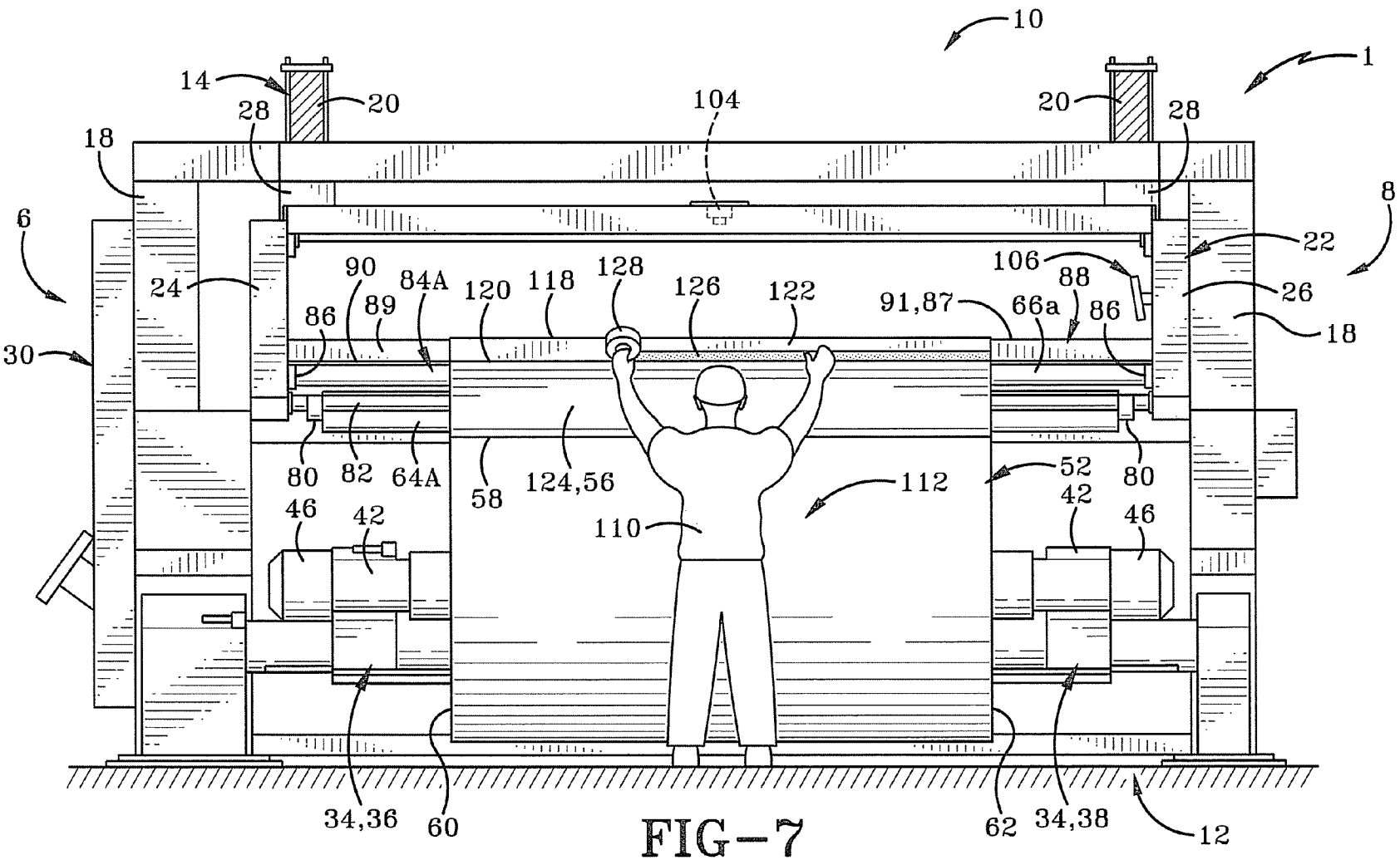
FIG. 7 is similar to FIG. 3 and shows the operator applying double-sided adhesive tape to the web along the protective plate.
Figure 8:
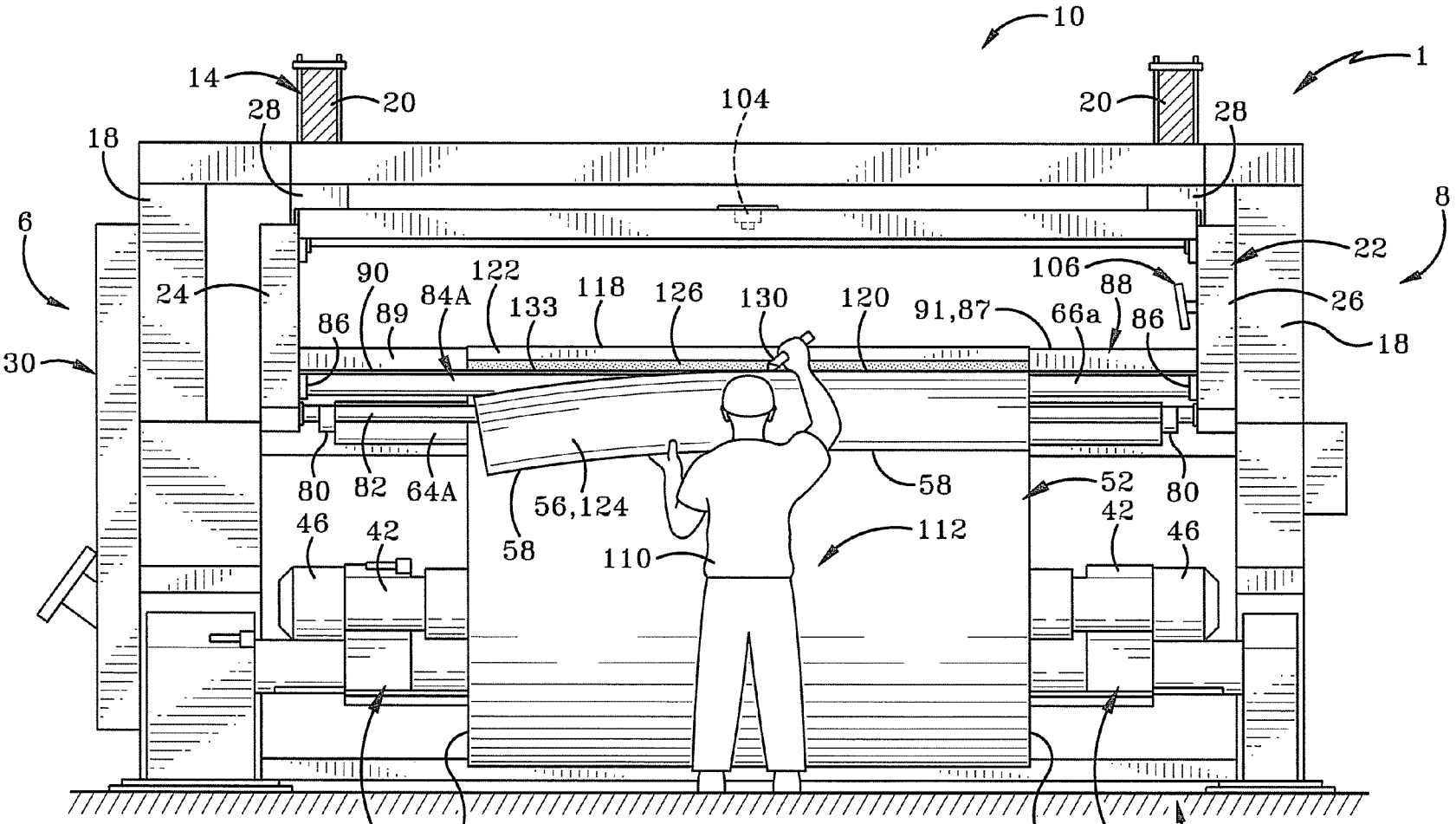
FIG. 8 is similar to FIG. 7 and shows the operator cutting the web along the cutting edge and tape.
Figure 9:
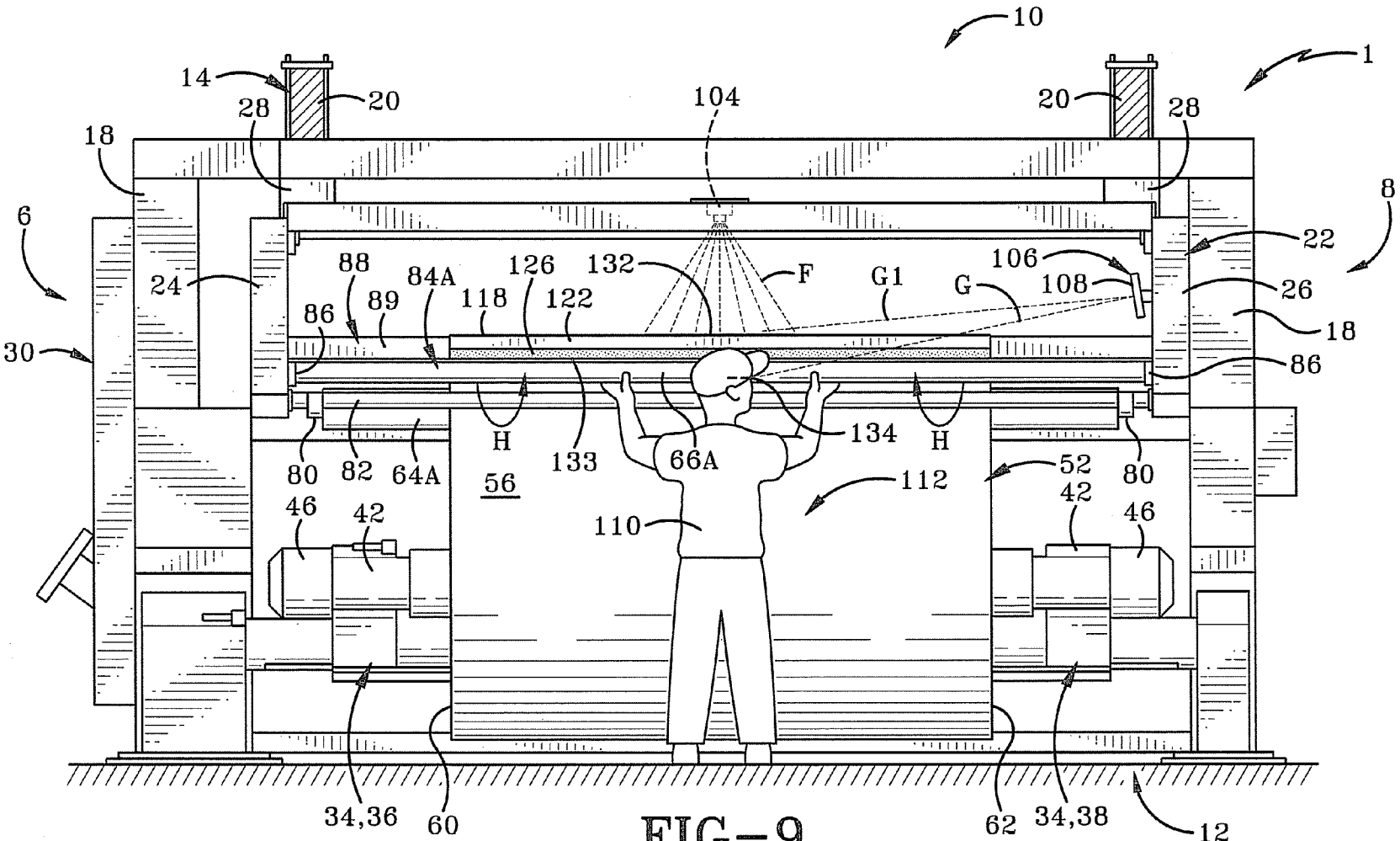
FIG. 9 is similar to FIG. 8 and shows the operator looking at the image display to view images of the alignment marker, paperboard and other components along the splice head while aligning the paperboard.

FIG. 7 illustrates operator 110 applying a two-sided or double-sided adhesive tape 126 to segment 122 as the tape is unrolled from a roll 128 thereof so that one adhesive side of tape 126 is adhered to the face of web 54 along segment 122 to extend from left edge 60 to right edge 62. A peel strip (not shown) is typically then removed from the opposite adhesive side so that the adhesive is exposed for the subsequent splicing to the web 54 of old roll 50. FIG. 8 illustrates operator 110 cutting web 56 from side 60 to side 62 with a knife 130 along cutting edge 90 in order to provide a substantially straight new leading edge 133 of web 56 which is perpendicular to edges 60 and 62 and is adjacent or coincident with an edge of tape 126. This cutting process may involve cutting a portion of tape 126 as well as web 56 such that the new leading end edge includes a leading edge of tape 126. Making this cut thus removes disposable segment 124 from tape receiving segment 122. Although the Figures show tape 126 being applied before the cut is made, these steps may be reversed.

Once the tape has been applied and the cut has been made to form new leading edge 133, operator 110 will begin aligning leading end edge 133 with the proper alignment position on the splice head. In the exemplary embodiment, device 104 is operated (switched from an off or inactivated mode to an on or activated mode) to produce or emit a laser beam or light rays (dashed lines F in FIGS. 9, 10 and 12) to produce an alignment marker 132 which is formed of light and is displayed adjacent the splice head. Preferably, the alignment marker 132 forms an axially elongated line along the splice head which is parallel to the splice roll, and the axis about which the splice roll and other rolls rotate. As previously noted, machine 1 is configured so that various of its components are higher than the viewing position, eyes or eye level 134 of operator 110 when operator 110 is standing on floor 16 at position 112, including the alignment position at which end edge 58 is to be aligned, the top of clamping bar 94, the top of splice roll 66A and the top of protective plate 88. Thus, operator 110 cannot directly see the top of the splice head, including the aforementioned components, alignment marker 104 and the alignment position. Consequently, operator 110 cannot directly see the edge 58 of web 56 when edge 58 is adjacent the alignment position above and adjacent the splice head.

Figure 11:
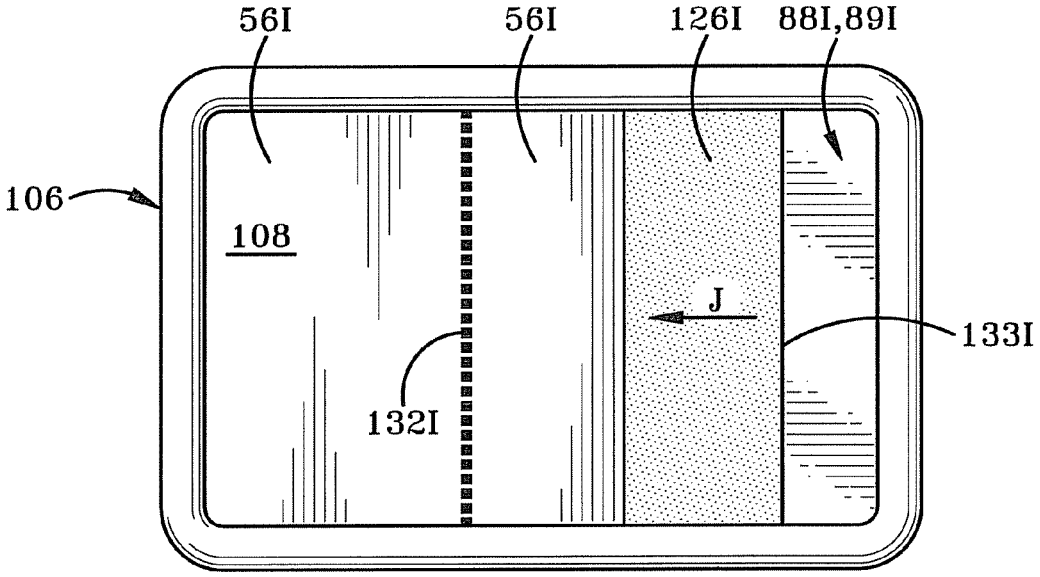
FIG. 11 is an enlarged view of the image display device showing images of the alignment marker, leading end edge of the paperboard and other components viewed by the operator at the stage shown in FIGS. 9 and 10.

To overcome this problem, operator 110 while standing in position 112, looks directly at image display 108 along a direct line of sight (dashed line G in FIG. 9) in order to see or view images therein, as represented at FIG. 11, including an image 56I of the web, an image 132I of the alignment marker shown on the web, an image 126I of the exposed adhesive of the double-sided tape which is adhered to the web 56, an image 133I of the new leading end edge and an image 88I of a portion of the protective plate. When image display device 106 is a mirror, these images are reflected images reflected from the actual components to the mirror along an indirect line of sight (dashed line G1 in FIG. 9). Alternately, when display device 106 includes a display screen and a camera, the camera views the various components along the dashed line G1 or analogous path. When a mirror is used, the images are thus reflected images whereas when a camera and display screen are used, the images are electronically reproduced photographic images which operator 110 views along direct line of sight G.

Figure 10:
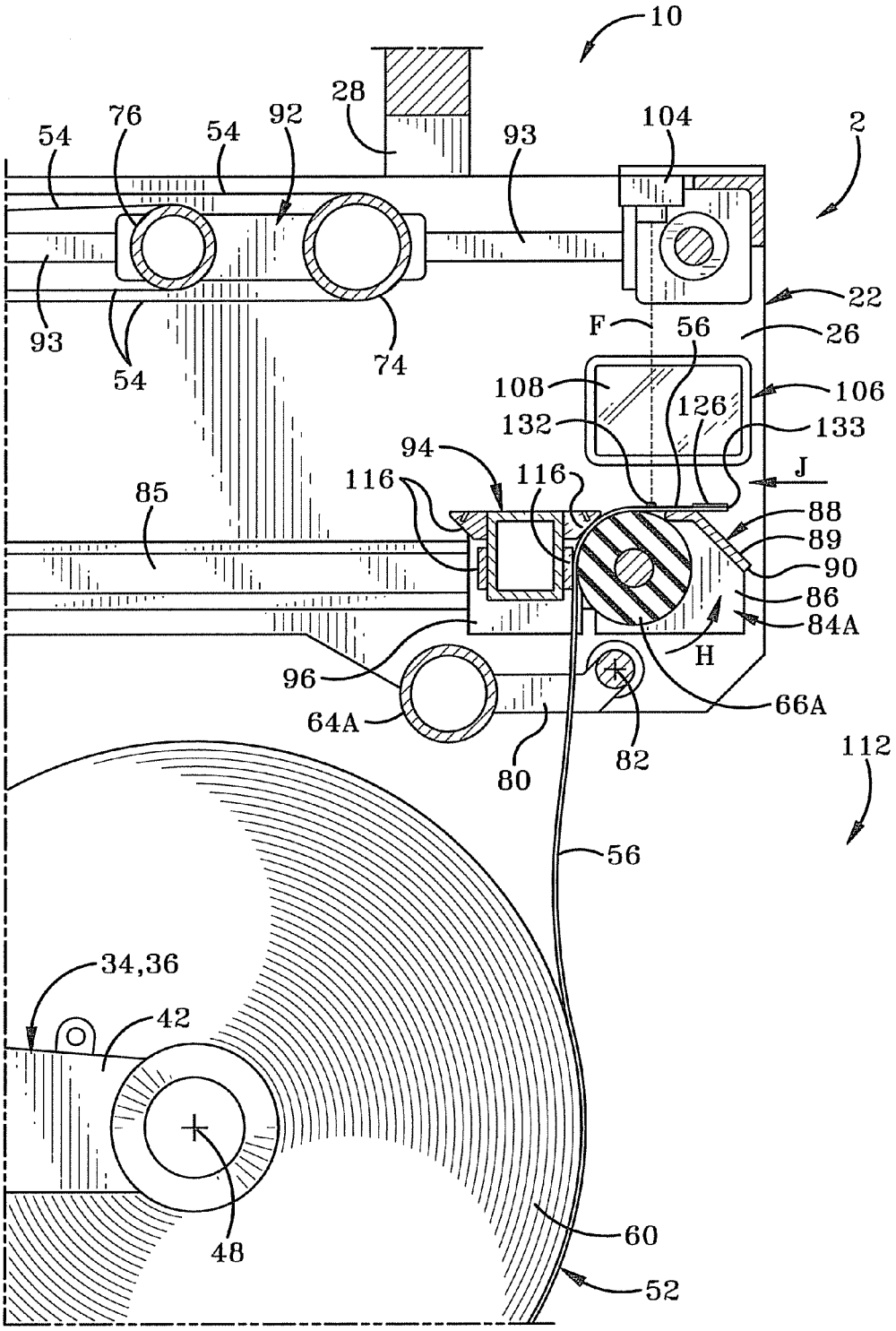
FIG. 10 is similar to FIG. 6 and shows the operation at the same stage as shown in FIG. 9.
Figure 13:
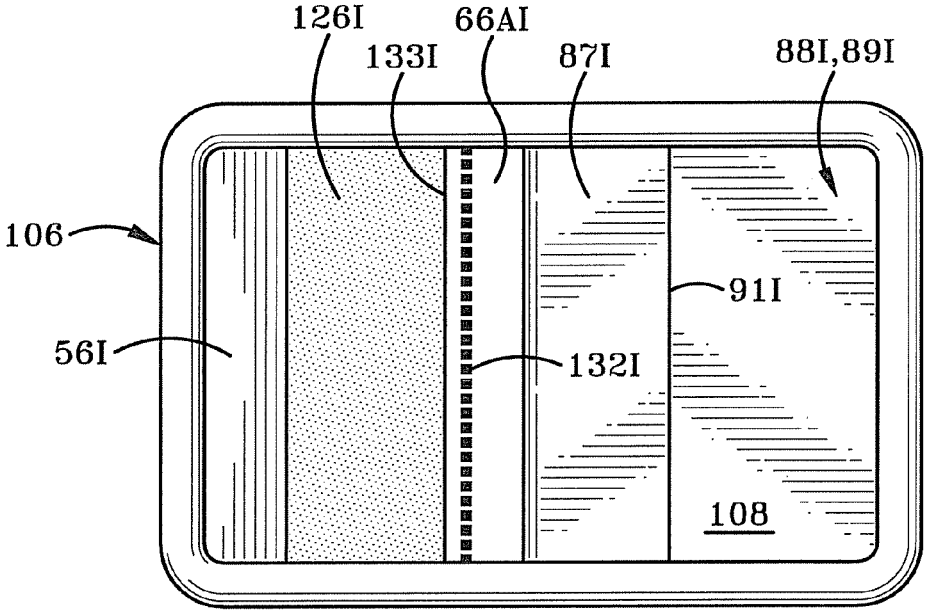
FIG. 13 is similar to FIG. 11 and shows the images associated with the aligned position shown in FIG. 12.

While operator 110 views the images, he or she manually manipulates splice roll 66A to rotate the splice roll (Arrows H in FIGS. 9 and 10) such that the frictional engagement between the outer circumference of splice roll 66A and web 56 causes web 56 to move downwardly between splice roll 66A and clamping bar 94 toward roll 52, thus moving end edge 58 and tape 126 away from operator 110 and toward the alignment position shown by alignment marker 132, as indicated by Arrows J in FIGS. 10 and 11. Operator 110 thus watches the images on image display 108 while rotating the splice roll to move the end edge 133 relative to and into alignment with or adjacent alignment marker 132, which the operator views as moving image 133I into alignment with or adjacent image 132I, as shown in FIG. 13.

Figure 12:
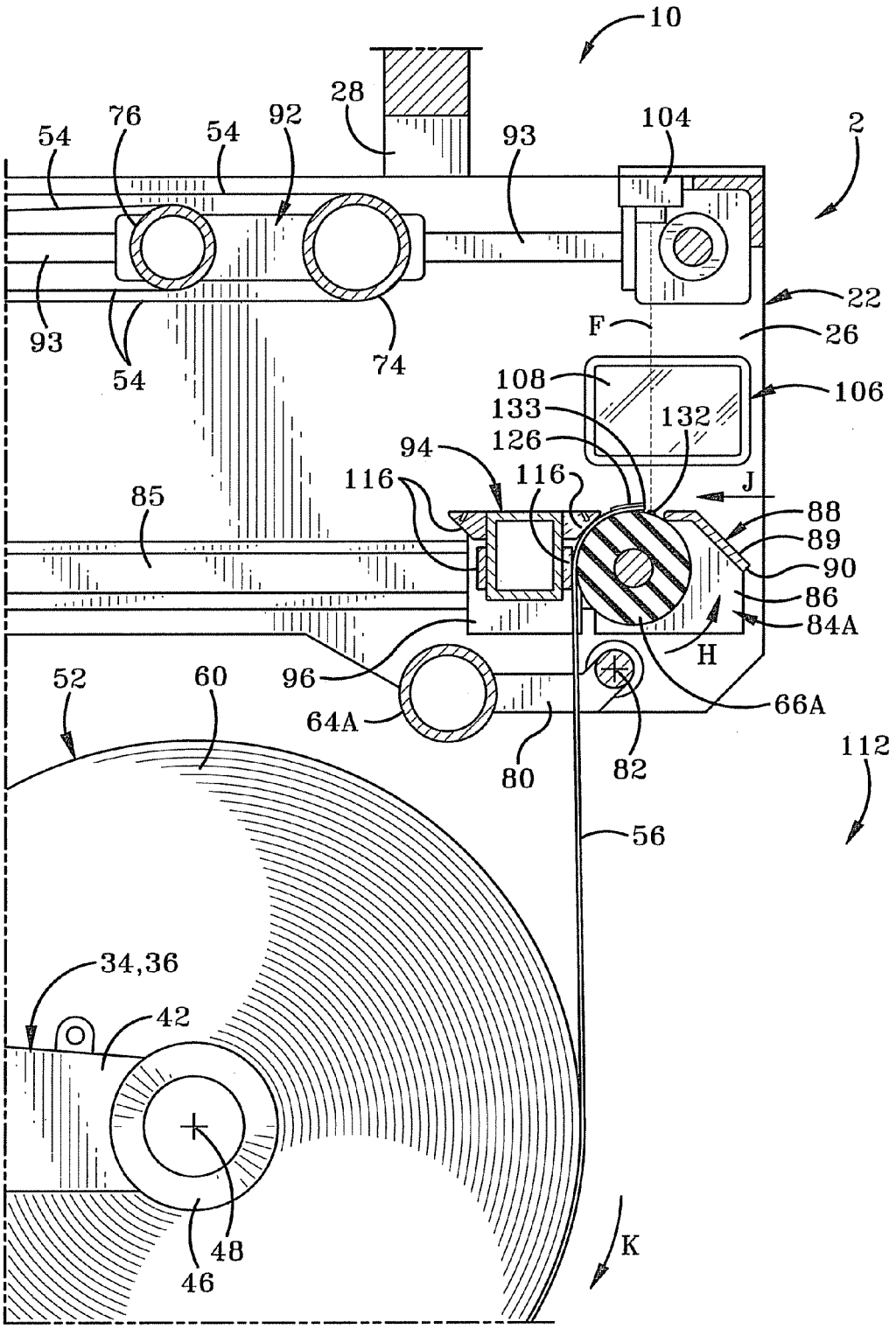
FIG. 12 is similar to FIG. 10 and shows the paperboard having been further moved into its aligned position.
Figure 14:
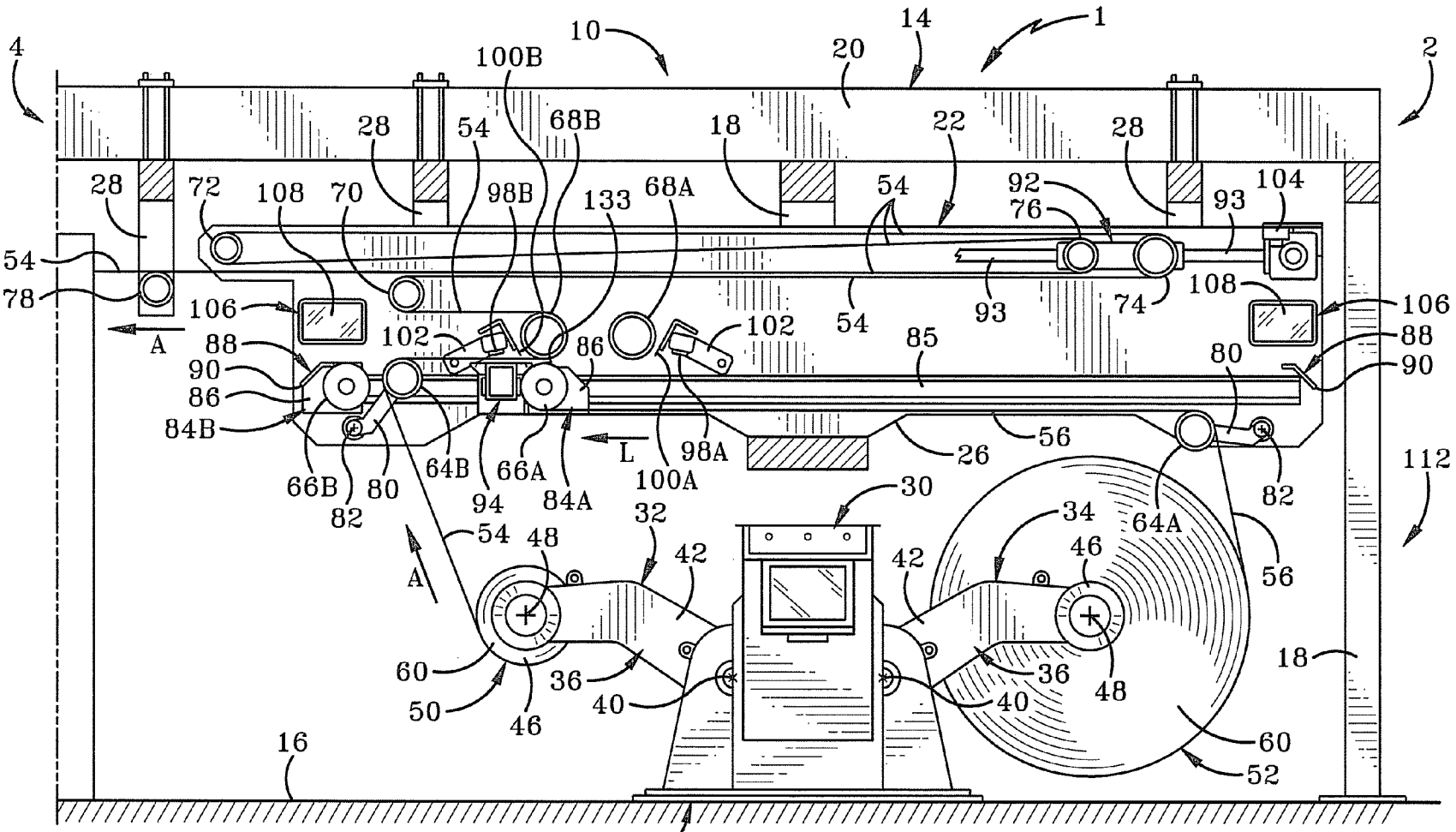
FIG. 14 is similar to FIG. 2 and shows the clamping bar and splice roll associated with the new paperboard roll having moved longitudinally (to the left in the Figure) from the aligning position adjacent the operator alignment and viewing position to the splicing position distal the operator alignment and viewing position.

Thus, as operator 110 rotates splice roll 66A to move web 56 as noted above from the unaligned position shown in FIG. 10 to the aligned position shown in FIG. 12, alignment marker 132 will typically first be displayed during this process on the upper surface of web 56, then on the upper surface of tape 126, and then on splice roll 66A as end edge 133 moves into alignment with marker 132 or slightly past marker 132. Operator 110 will consequently see images analogous to this movement except that image 132I appears on image 56I, then on image 126I, and then on image 66AI. As further shown in FIG. 13, the movement of web 56 from the unaligned position of FIG. 10 to the aligned position of FIG. 12 will typically expose the remainder of plate 88 as viewed from above as web 56 moves from a position covering or partly covering plate 88 to a position in which web 56 does not cover plate 88 at all. Thus, operator 110 is able to see images 87I of the upper plate segment of plate 88 as well as image 91I of the angle of plate 88 when the end edge 58 is in the aligned position. The rotational movement of splice roll 66A (Arrows H) to move web 56 from the unaligned position to the aligned position occurs while clamping bar 94 is applying the previously noted relatively light clamping pressure on web 56, thereby allowing for the movement of web 56 between splice roll 66A and clamping bar 94. However, once the web has been aligned, machine 1 is operated to apply a greater clamping force with clamping bar 94 such that web 56 is securely clamped between clamping bar 94 and splice roll 66A in order to prevent additional movement of web 56 therebetween and consequently maintain the aligned position of end edge 58 relative to the splice head.

Once the alignment procedure has been completed and the web 56 is securely clamped between the clamping bar and splice roll as just mentioned, machine 1 is prepared for the splicing process. With web 56 securely clamped between clamping rod 94 and roll 66A, splice carriage 84A and clamping bar carriage 96 are moved as a unit (Arrow L in FIG. 14) from the alignment position adjacent the operator alignment and viewing position 112 to a splicing position (FIG. 14) distal position 112. More particularly, the clamping bar and splice roll 66A are positioned adjacent and below brake bar 98B, knife 110B and pressure roll 68B. New webs 54 and 56 are then spliced in a standard manner as illustrated in FIGS. 15 and 16.

Figure 15:
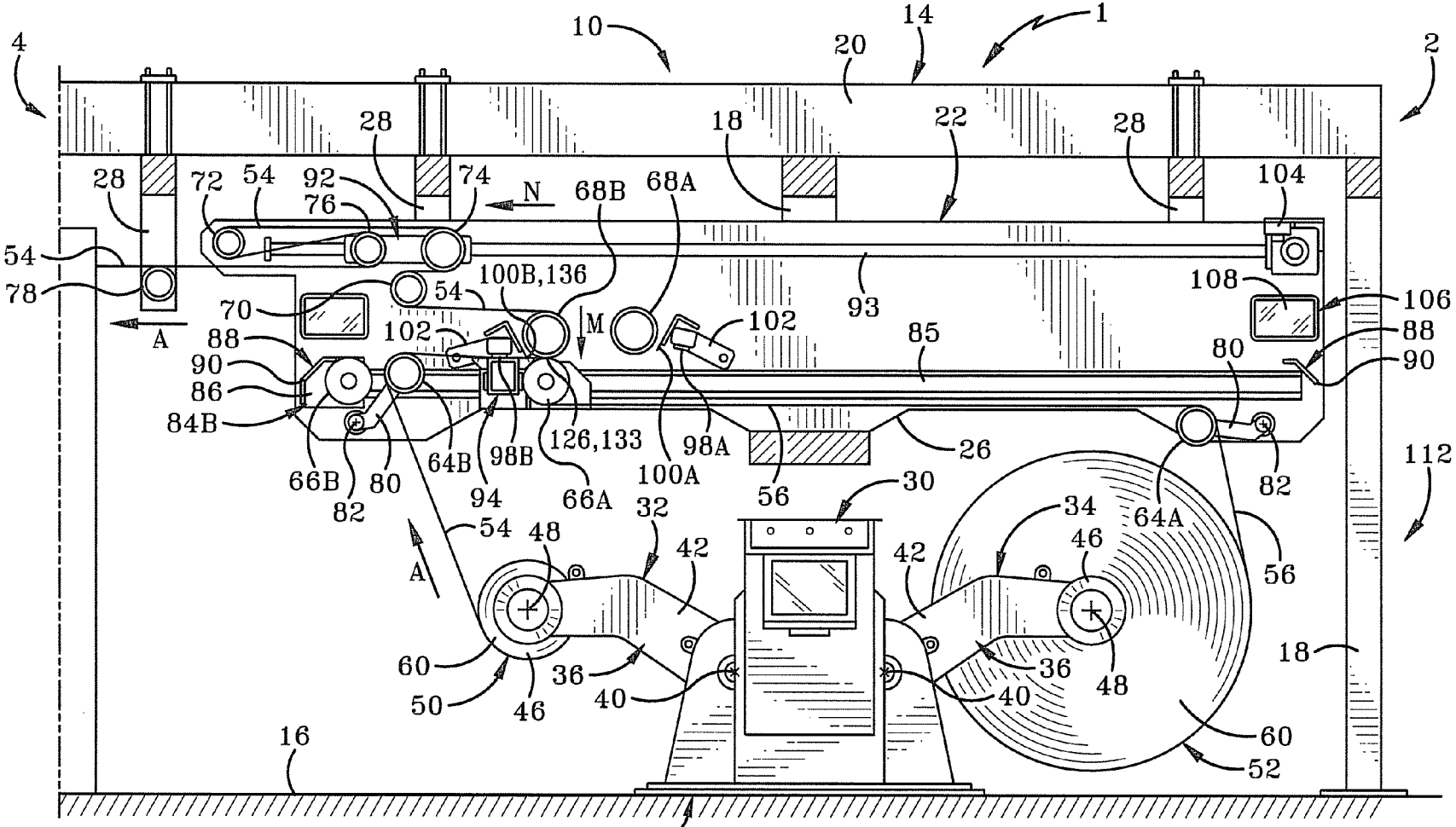
FIG. 15 is a similar to FIG. 14 and shows the cutting and splicing operation as the festoon carriage moves longitudinally (to the left) as the web moves downstream out of the web storage.
Figure 16:
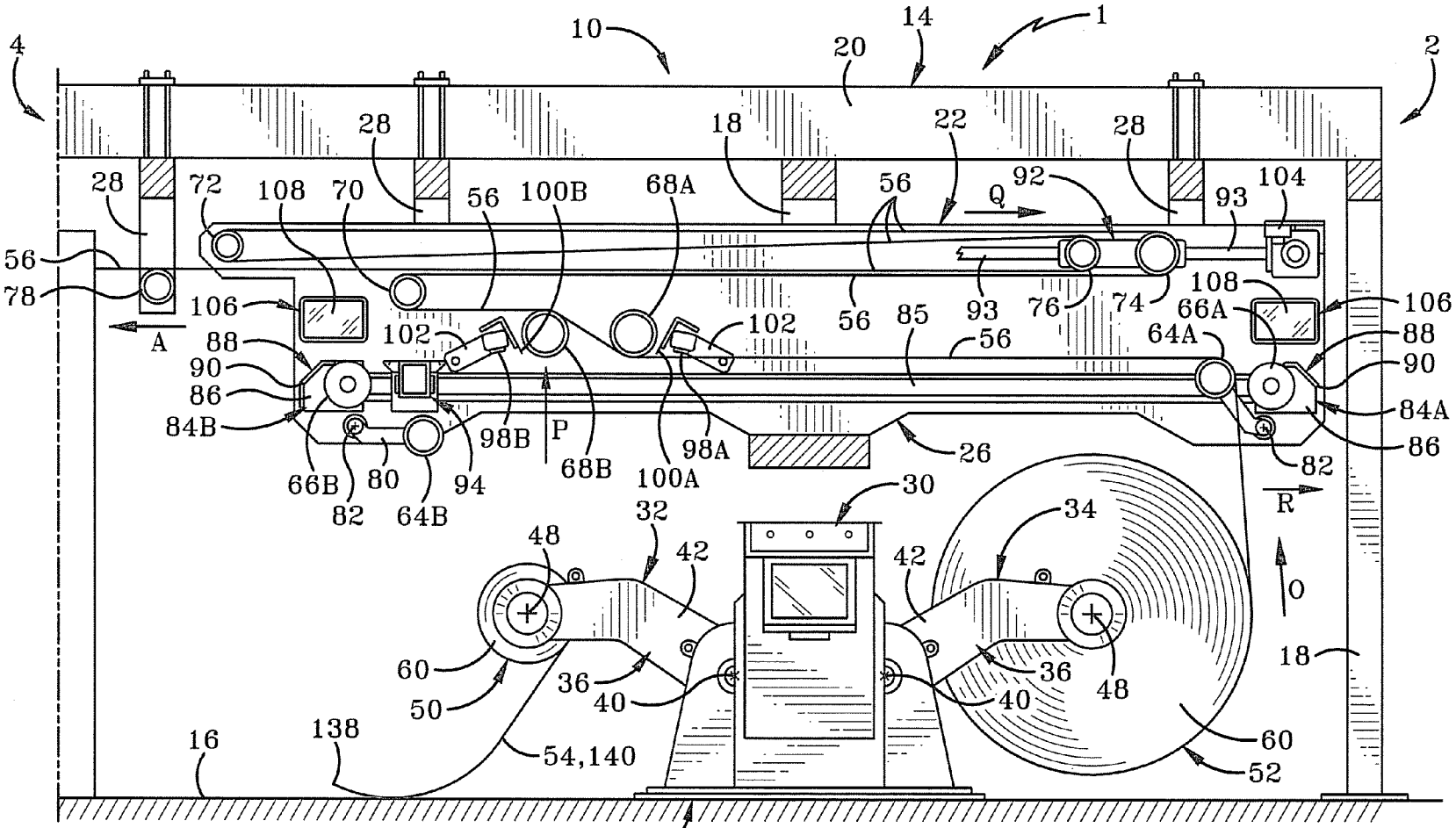
FIG. 16 is similar to FIG. 15 and shows the spliced web moving downstream, the splice carriage moved back to its aligning position and the festoon carriage moved longitudinally in the opposite direction to refill the web storage.

More particularly, as shown in FIG. 15, brake bar 98B is pivoted in order to clamp web 54 between brake bar 98B and clamping bar 94, thus stopping the downstream movement of web 54 momentarily in the area adjacent the splice head. At the same time, pressure roll 68B is moved downwardly to momentarily clamp web 56 adjacent leading end edge 133, tape 126 and web 54 adjacent the trailing end edge 136 thereof newly formed by the cut made by knife 100B, which more particularly cuts web 54 from left side edge 60 to right side edge 62. The downward movement of brake bar 98B, knife 100B and pressure roll 68B is represented at Arrow M in FIG. 15. While brake bar 98B secures web 54 against clamping bar 94 and pressure roll 68B secures the two webs and tape against splice roll 66A so that webs 54 and 56 are spliced via tape 126 and so that the spliced web cannot move downstream therefrom momentarily, festoon carriage 92 moves (Arrow N) from its filled position toward an unfilled position shown generally in FIG. 15 so that web 54 downstream of fixed roll 70 continues to move downstream out of the storage of web 54 provided between the various festoon rolls.

Once web 54 and web 56 have been spliced, brake bar 98B, knife 100B and pressure roll 68B move back upwardly (Arrow P in FIG. 16) so that web 56 begins to unwind (Arrow O) from roll 52 and so that web 54 and web 56 form a spliced web which continues downstream through the festoon rolls and out of the splicer machine past exit roll 78. FIG. 16 thus shows only web 56 wound through the various rolls of splicer 1. The cutting of web 54 thus produces a leading end edge 138 of a remaining portion 140 of web 54, which is shown in FIG. 16. Once the splicing of the two webs has occurred, festoon carriage 92 moves back (Arrow Q) to the filled position to refill the storage with web 56 in preparation for subsequent splicing of an additional new roll. Furthermore, splice carriage 84A carries splice roll 66A back from the splicing position to its alignment position (Arrow R). In addition, clamping bar 94 moves from the splicing position shown in FIG. 15 toward splice roll 66B in preparation for aligning the end edge of a new roll which will be mounted on roll support assembly 32 after old roll 50 has been removed therefrom. Once a new roll has been placed on roll support assembly 32, operator 110 will perform the alignment procedure once again except from a position downstream of the splice head which includes splice roll 66B and which utilizes clamping bar 94 in conjunction therewith. To that effect, another image display device 106 is provided to allow the operator to view images of the alignment marker and the like associated with splice roll 66B.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of the invention is an example and the invention is not limited to the exact details shown or described.

The invention claimed is:

1. A method comprising the steps of:

providing a paperboard splicing machine having left and right sides defining therebetween an axial direction and comprising a splice head which has an alignment position, a splice roll, a clamping bar and a cutting plate having an axially elongated cutting edge upstream of the splice roll, wherein the splice roll and clamping bar define therebetween a space;

providing a first paperboard roll having left and right ends which serve as left and right side edges of a first web of the paperboard roll, wherein the first paperboard roll is rotatably mounted on the paperboard splicing machine to rotate about an axially extending axis;

inserting the first web upwardly through the space away from the first paperboard roll and then pulling the first web upstream away from the alignment position toward an operator over the splice roll and cutting plate so that some excess of the first web hangs downwardly from the cutting edge;

after the steps of inserting and pulling, cutting the first web along the cutting edge to provide an axially elongated leading end edge of the first web which extends from the left side edge to the right side edge of the first web;

operating a light-emitting device to produce an alignment marker which is formed of light and is displayed along the alignment position on an upper surface of the first web;

clamping the first web between the splice roll and clamping bar;

providing an image display device;

viewing with the image display device an image of the leading end edge and an image of the alignment marker; and after the step of cutting, aligning the leading end edge at the alignment position during the step of viewing by the operator manually moving the first web downwardly through the space toward the first paperboard roll and moving the leading end edge downstream over the splice roll and cutting plate away from the operator toward the alignment marker and into alignment with or adjacent the alignment marker such that the operator views the step of moving the leading end edge downstream as moving the image of the leading end edge into alignment with or adjacent the image of the alignment marker;

wherein the operator performs the steps of viewing and aligning while standing at an alignment and viewing position which is adjacent the first paperboard roll between the left and right ends of the first paperboard roll and at which the operator cannot directly see the leading end edge when the leading end edge is above and adjacent the splice head during the steps of viewing and aligning.

2. The method of claim 1 wherein the image display device comprises a mirror; and the image is reflected in the mirror and is not a photographic image.

3. The method of claim 2 wherein the mirror is higher than an eye level of the operator while the operator is standing at the alignment and viewing position.

4. The method of claim 1 wherein the step of producing operating comprises the step of producing the alignment marker with a laser beam.

5. The method of claim 1 wherein the images are reflected in a mirror.

6. The method of claim 1 wherein the step of viewing comprises the step of viewing an image of the splice head.

7. The method of claim 1 wherein the step of viewing comprises the step of viewing an image of the splice roll.

8. The method of claim 7 wherein the step of viewing comprises the step of viewing an image of the clamping bar.

9. The method of claim 7 wherein the step of viewing comprises the step of viewing an image of the cutting plate.

10. The method of claim 1 wherein the step of aligning comprises the step of rotating the splice roll by manually manipulating the splice roll such that frictional engagement between an outer circumference of the splice roll and the first web causes the first web to move.

11. The method of claim 1 further comprising the step of manually applying adhesive tape to the web adjacent the end edge.

12. The method of claim 11 further comprising the step of splicing the first web and a second web of a second paperboard roll so that the adhesive tape secures the webs to one another.

13. The method of claim 1 further comprising the step of splicing the first web and a second web of a second paperboard roll.

14. The method of claim 13 wherein the operator performs the step of aligning by manually manipulating the first web while the operator is at the operator alignment and viewing position which is upstream of the first paperboard roll; and further comprising the step of moving the splice head and end edge of the first web therewith from adjacent the operator alignment and viewing position to a splicing position distal and downstream of the viewing position; and wherein the step of splicing comprises the step of splicing the first web and second web at the splicing position.

15. The method of claim 1 further comprising the steps of providing a second paperboard roll having left and right ends which serve as left and right side edges of a second web of the second paperboard roll;

cutting the second web with a knife of the splicing machine to produce a trailing end edge of the second web which extends from the left side edge of the second web to the right side edge of the second web; and splicing the first and second webs along the leading end edge of the first web and the trailing end edge of the second web to produce a spliced web; and wherein the step of aligning occurs while the second web is moving downstream through the splicing machine.

16. The method of claim 15 wherein the splicing machine comprises a plurality of festoon rolls including a fixed festoon roll and a movable festoon roll rotatably mounted on a festoon carriage which is movable between a filled position and an unfilled position;

the second web is wound around the plurality of festoon rolls to provide a storage of the second web between the plurality of festoon rolls; and while the spliced web is secured so that the spliced web cannot move downstream momentarily, the festoon carriage moves from the filled position toward the unfilled position so that the second web downstream of the fixed roll continues to move downstream out of the storage.

17. The method of claim 1 wherein the alignment marker is axially elongated.

18. The method of claim 17 wherein the splice roll rotates about an axially extending axis; and the alignment marker is parallel to the axis about which the splice roll rotates.

19. The method of claim 18 further comprising the step of applying adhesive tape to the web adjacent the leading end edge;

wherein the step of aligning the first web is performed so that the alignment marker is first displayed on the upper surface of the first web and then on an upper surface of the tape.

* * * * *

UNITED STATES PATENT AND TRADEMARK OFFICE

CERTIFICATE OF CORRECTION

PATENT NO. : 9,067,750 B2
APPLICATION NO. : 13/032684
DATED : June 30, 2015
INVENTOR(S) : Casey et al.

It is certified that error appears in the above-identified patent and that said Letters Patent is hereby corrected as shown below:

In the Claims

Column 9, line 12 (Claim 4) change "step of producing operating" to --step of operating--

Signed and Sealed this
Tenth Day of November, 2015

Michelle K. Lee

Michelle K. Lee
*Director of the United States Patent and Trademark Office*